US011259397B2

(12) United States Patent
Kuninaka

(10) Patent No.: US 11,259,397 B2
(45) Date of Patent: Feb. 22, 2022

(54) MICROWAVE PLASMA SOURCE

(71) Applicant: Japan Aerospace Exploration Agency, Tokyo (JP)

(72) Inventor: Hitoshi Kuninaka, Tokyo (JP)

(73) Assignee: JAPAN AEROSPACE EXPLORATION AGENCY

( * ) Notice: Subject to any disclaimer, the term of this patent is extended or adjusted under 35 U.S.C. 154(b) by 0 days.

(21) Appl. No.: 16/652,434

(22) PCT Filed: Nov. 22, 2018

(86) PCT No.: PCT/JP2018/043122
§ 371 (c)(1),
(2) Date: Mar. 31, 2020

(87) PCT Pub. No.: WO2019/103083
PCT Pub. Date: May 31, 2019

(65) Prior Publication Data

US 2020/0288560 A1 Sep. 10, 2020

(30) Foreign Application Priority Data

Nov. 24, 2017 (JP) ..... JP2017-225696

(51) Int. Cl.
*H05H 1/46* (2006.01)
*H05H 1/02* (2006.01)

(52) U.S. Cl.
CPC ..... *H05H 1/46* (2013.01); *H05H 1/02* (2013.01); *H05H 1/463* (2021.05)

(58) Field of Classification Search
CPC ..... H05H 1/46; H05H 1/02; H05H 2001/463
See application file for complete search history.

(56) References Cited

U.S. PATENT DOCUMENTS 4,778,561 A 10/1988 Ghanbari
6,297,594 B1 10/2001 Sakai et al. ..... 315/111.41
(Continued)

FOREIGN PATENT DOCUMENTS

CN 101127413 A 2/2008
CN 101517691 A 8/2009
(Continued)

OTHER PUBLICATIONS

Kubota et al. "Three-dimensional Hybrid-PIC Simulation of Microwave Neutralizer"; publication date: Oct. 2013 (Year: 2013).*
(Continued)

*Primary Examiner* — Borna Alaeddini
(74) *Attorney, Agent, or Firm* — Ostrolenk Faber LLP

(57) ABSTRACT

In a microwave plasma source, a tubular magnet portion has a first opening end and a second opening end. The first opening end has a first polarity, and the second opening end has a second polarity. The tubular body is surrounded by the tubular magnet portion. A first magnetic circuit portion closes the first opening end. A second magnetic circuit portion is disposed opposite to the first magnetic circuit portion. The second magnetic circuit portion has a first opening part. An antenna penetrates the first magnetic circuit portion, is introduced to a space, and supplies microwave power to the space. The nozzle portion has a second opening part that has a smaller opening area than the first opening part and communicates with the first opening part. When an inner diameter of the tubular body is represented by a (mm), and a microwave cutoff wavelength of the microwave power being supplied to the space is represented by λ (mm), the microwave plasma source is configured to satisfy a relational expression $\lambda > 3.41 \times (a/2)$.

9 Claims, 5 Drawing Sheets

(56) References Cited

U.S. PATENT DOCUMENTS

| | | | |
|---|---|---|---|
| 6,320,321 | B2 | 11/2001 | Ogura |
| 9,668,332 | B2 | 5/2017 | Chen |

FOREIGN PATENT DOCUMENTS

| | | | | |
|---|---|---|---|---|
| JP | 04-059974 | A | | 2/1992 |
| JP | 06-325896 | A | | 11/1994 |
| JP | H09245658 | A | * | 3/1996 |
| JP | 09-245658 | A | | 9/1997 |
| JP | 2000-223299 | A | | 8/2000 |
| JP | 2001-006898 | A | | 1/2001 |
| JP | 3364830 | B2 | | 1/2003 |
| JP | 2003-162981 | A | | 6/2003 |
| JP | 2004-152940 | A | | 5/2004 |
| JP | 2004-247676 | A | | 9/2004 |
| JP | 6185538 | B2 | | 8/2017 |

OTHER PUBLICATIONS

International Search Report dated Feb. 19, 2019 in corresponding PCT International Application No. PCT/JP2018/043122.

Written Opinion dated Feb. 19, 2019 in corresponding PCT International Application No. PCT/JP2018/043122.

Office Action dated Apr. 16, 2019 in corresponding Japanese Patent Application No. 2017-225696, along with an English translation thereof.

N. Onodera et al., "Electron Emission Mechanism of Microwave Discharge Neutralizer," Aeronautical and Space Sciences Japan, vol. 49, No. 564, pp. 27-31, 2001, (with an English language abstract).

Y. Tani et al., "Development of Large-current Microwave Discharge Neutralizer," Proceedings of Space Transportation Symposium FY2015, STEP-2015-058, 4 pages, Jan. 2016, (see ISR for relevance).

H. Kuninaka et al., "Microwave Plasma Contactor," 23rd International Electric Propulsion Conf., IEPC93-040, 5 pages, 1993.

H. Kuninaka, "Research and Development of Cathode-less Microwave Discharge Ion Thruster System," Aeronautical and Space Sciences Japan, vol. 46, No. 530, pp. 174-180, 1998, (see ISR and Japanese Office Action for relevance).

Y. Maeda, Study on Life Evaluation of Microwave Discharge Neutralizing device in Ion Engine, Kyushu University, Faculty of Engineering, Undergraduate Thesis, Japan, Kyushu University, 52 pages, Feb. 2014, (see Japanese Office Action for relevance).

Chinese Office Acton and Search Report, dated Aug. 25, 2021, issued in corresponding Chinese Patent Application No. 201880062705.2. English translation of Search Report. Total 9 pages.

Korean Office Action, dated Nov. 23, 2021, issued in corresponding Korean Patent Application No. 10-2020-7008929. English translation. Total 12 pages.

Kubota Kenichi, et al., "Three-dimensional Hybrid-PIC Analysis on Electron Extraction of a Microwave Neutralizer", Journal of the Japan Society for Aeronautical and Space Sciences, vol. 63, No. 5, pp. 23-29 (Oct. 1, 2015). Includes English Abstract.

* cited by examiner

MICROWAVE PLASMA SOURCE

CROSS-REFERENCE TO RELATED APPLICATIONS

The present application is a 35 U.S.C. §§ 371 national phase conversion of PCT/JP2018/043122, filed Nov. 22, 2018, which claims priority to Japanese Patent Application No. 2017-225696, filed Nov. 24, 2017, the contents of which are incorporated herein by reference. The PCT International Application was published in the Japanese language.

TECHNICAL FIELD

The present invention relates to a microwave plasma source for which electron cyclotron resonance is used.

BACKGROUND ART

As one of plasma sources, there is a source that accelerates thermions emitted from a hot cathode to generate plasma. As typical examples of the hot cathode, there are a filament cathode and a hollow cathode. The hot cathode is heated by energization or Joule heating using a heater to maintain a high-temperature state of approximately 1,000 K (Kelvin) and emit thermions.

However, for the hot cathode, long preheating before the beginning of the operation and a thorough operation temperature management become necessary. For example, in a case where the temperature of the electrode is too low, electrons are not emitted from the electrode, and, in a case where the temperature is too high, an electrode material evaporates, and the electrode service life becomes short. In addition, a filament is directly exposed to ion beams and is thus likely to wear. In addition, there is a case where heavy metal evaporated from the electrode material having a low work function attaches to peripheral components, which also causes contamination. Furthermore, the electrode material having a low work function deteriorates due to exposure to an air atmosphere, and thus maintenance management such as vacuum storage and gas purging becomes necessary even when the hot cathode is idle.

In contrast, there is a plasma source in which microwaves are used as a discharge power and electron cyclotron resonance is used. Such a plasma source does not have any electrodes and generates a strong electric field in a cavity using a waveguide or the like to generate high-density plasma (for example, refer to Non-Patent Literature 1).

CITATION LIST

Non-Patent Literature

[NPL 1] Noriyoshi Onodera and four cowriters "Electron Emission Mechanism of Microwave Discharger Neutralizer" Journal of the Japan Society for Aeronautical and Space Sciences, Volume 49, Issue 564 (January 2001), p. 27 to 31

DISCLOSURE OF INVENTION

Technical Problem

However, when a cavity resonator or the cavity is equal to or larger than the wavelength of microwaves in size, not only does the plasma source increase in size, but there is also a possibility of microwaves leaking from the plasma source.

In a case where microwaves leak from the plasma source, the plasma source becomes a noise source, which creates a need for noise countermeasures for peripheral devices.

In consideration of the above-described circumstances, an object of the present invention is to provide a microwave plasma source that forms high-density plasma and suppresses the leakage of microwaves.

Solution to Problem

In order to attain the above-described object, a microwave plasma source according to one aspect of the present invention includes a tubular magnet portion, a tubular body, a first magnetic circuit portion, a second magnetic circuit portion, an antenna, a nozzle portion, a gas port portion, and an insulating member.

The tubular magnet portion has a first opening end and a second opening end located on a side opposite to the first opening end. The first opening end has a first polarity, and the second opening end has a second polarity opposite to the first polarity.

The tubular body is surrounded by the tubular magnet portion.

The first magnetic circuit portion is in contact with the first opening end and closes the first opening end.

The second magnetic circuit portion is in contact with the second opening end and is disposed opposite to the first magnetic circuit portion.

The second magnetic circuit portion has a first opening part that opens a space surrounded by the tubular body.

The antenna penetrates the first magnetic circuit portion, is introduced to the space and is capable of supplying microwave power to the space.

The nozzle portion is in contact with the second magnetic circuit portion on a side opposite to the first magnetic circuit portion. The nozzle portion has a second opening part that has a smaller opening area than the first opening part and communicates with the first opening part.

The gas port portion penetrates the tubular magnet portion and the tubular body and is capable of supplying a discharge gas to the space.

The insulating member is provided between the antenna and the first magnetic circuit portion.

When an inner diameter of the tubular body is represented by a (mm), and a microwave cutoff wavelength of the microwave power being supplied to the space is represented by $\lambda$ (mm), the microwave plasma source is configured to satisfy a relational expression $\lambda>3.41\times(a/2)$.

According to the above-described microwave plasma source, electron cyclotron resonance occurs in the space due to an interaction between microwaves and a magnetic field. Therefore, energy is selectively and directly supplied to electrons in plasma, and electrons having a high energy and the discharge gas collide with each other, thereby generating high-density plasma in the space. Furthermore, the microwave plasma source is configured to satisfy the relational expression $\lambda>3.41\times(a/2)$, and thus, in the space, microwaves do not easily resonate, and the progress of microwaves in the space is suppressed. As a result, microwaves do not easily leak from the microwave plasma source.

In the microwave plasma source, the first magnetic circuit portion may have a tubular protrusion portion that protrudes toward the nozzle portion from the first magnetic circuit portion in the space.

The protrusion portion may surround part of the antenna.

The protrusion portion may include a tip portion tapering toward a corner portion at which a main surface of the second magnetic circuit portion on a first magnetic circuit portion side and an inner wall of the first opening part intersect with each other.

A mirror ratio of a magnetic field formed between the tip portion and the corner portion may be three or higher.

According to the above-described microwave plasma source, the mirror magnetic field is formed between the protrusion portion and the corner portion, and electrons confined in the magnetic field are continuously heated by electron cyclotron resonance. Therefore, it is possible to generate high-energy electrons capable of ionizing the discharge gas even when an electric field of microwaves is weak.

In the microwave plasma source, at least any one of the tip portion and the corner portion may be configured to have an acute angle.

According to the above-described microwave plasma source, a mirror magnetic field having a high mirror ratio is formed between the protrusion portion and the corner portion, and electrons confined in the magnetic field are continuously heated by electron cyclotron resonance. Therefore, it is possible to generate high-energy electrons capable of ionizing the discharge gas even when an electric field of microwaves is weak.

In the microwave plasma source, an inner diameter of the first opening part may be larger than an outer diameter of the protrusion portion.

According to the above-described microwave plasma source, in the magnetic field, lines of magnetic force become less dense from the protrusion portion toward the corner portion. A magnetic flux density on a nozzle portion side becomes smaller than a magnetic flux density on a protrusion portion side. As a result, in the space, a low-magnetic field region is formed in the vicinity of the opening part of the nozzle portion, in the vicinity of the opening part, plasma is not easily trapped by the magnetic field, a mobility of the plasma in the vicinity of the opening part increases, and the plasma is efficiently sprayed from the opening part.

In the microwave plasma source, in the plasma generated by the discharge gas formed in the space, a density of the plasma exposed to the insulating member may be higher than a density of the plasma formed in the first opening part.

According to the above-described microwave plasma source, even when a foreign substance such as a contaminant or a coating is deposited on the insulating member during discharge, the foreign substance is immediately removed by a sputtering effect of the plasma.

In the microwave plasma source, the antenna may have a first antenna portion extending from the first magnetic circuit portion toward the nozzle portion and a second antenna portion that intersects with the first antenna portion and is connected to the first antenna portion.

According to the above-described microwave plasma source, the antenna is configured to bend, and microwaves are efficiently absorbed into the plasma.

In the microwave plasma source, the second antenna portion may be formed from a plurality of members, and the plurality of members each may intersect with the first antenna portion.

According to the above-described microwave plasma source, electron cyclotron resonance occurs in the space due to an interaction between microwaves supplied from the plurality of members and the magnetic field, and higher-density plasma is generated in the space. Therefore, it is possible to extract a larger electron current or ion current from the microwave plasma source.

In the microwave plasma source, the antenna may have a first antenna portion extending in a direction toward the nozzle portion from the first magnetic circuit portion and a second antenna portion formed in a disc shape or a cone shape. The first antenna portion may be connected to a central part of the second antenna portion.

According to the above-described microwave plasma source, electron cyclotron resonance occurs in the space due to an interaction between microwaves evenly supplied from the disc-shaped or cone-shaped second antenna portion and the magnetic field, and higher-density plasma is generated in the space. Therefore, it is possible to extract a larger electron current or ion current from the microwave plasma source.

In the microwave plasma source, in the gas port portion, a supply opening of the discharge gas may be disposed such that a distance between the supply opening and a tip of the antenna becomes shortest.

According to the above-described microwave plasma source, the discharge gas introduced to the space from the supply opening is efficiently ionized by microwaves emitted from the antenna, and high-density plasma is formed in the space.

The microwave plasma source may further include an electrode mechanism that withdraws charged particles in the plasma formed in the space using an electrostatic field.

According to the above-described microwave plasma source, it is possible to preferentially withdraw electrons or ions in the charged particles in the plasma from the microwave plasma source.

Advantageous Effects of Invention

As described above, according to the present invention, a microwave plasma source that forms high-density plasma and suppresses the leakage of microwaves is provided.

BRIEF DESCRIPTION OF DRAWINGS

FIG. 1(*b*) is a schematic top view thereof.

FIG. 4(*b*) is a schematic top view thereof.

DETAILED DESCRIPTION OF THE INVENTION

Hereinafter, an embodiment of the present invention will be described with reference to drawings. In the respective drawings, there is a case where XYZ coordinates are introduced.

Figure 1:
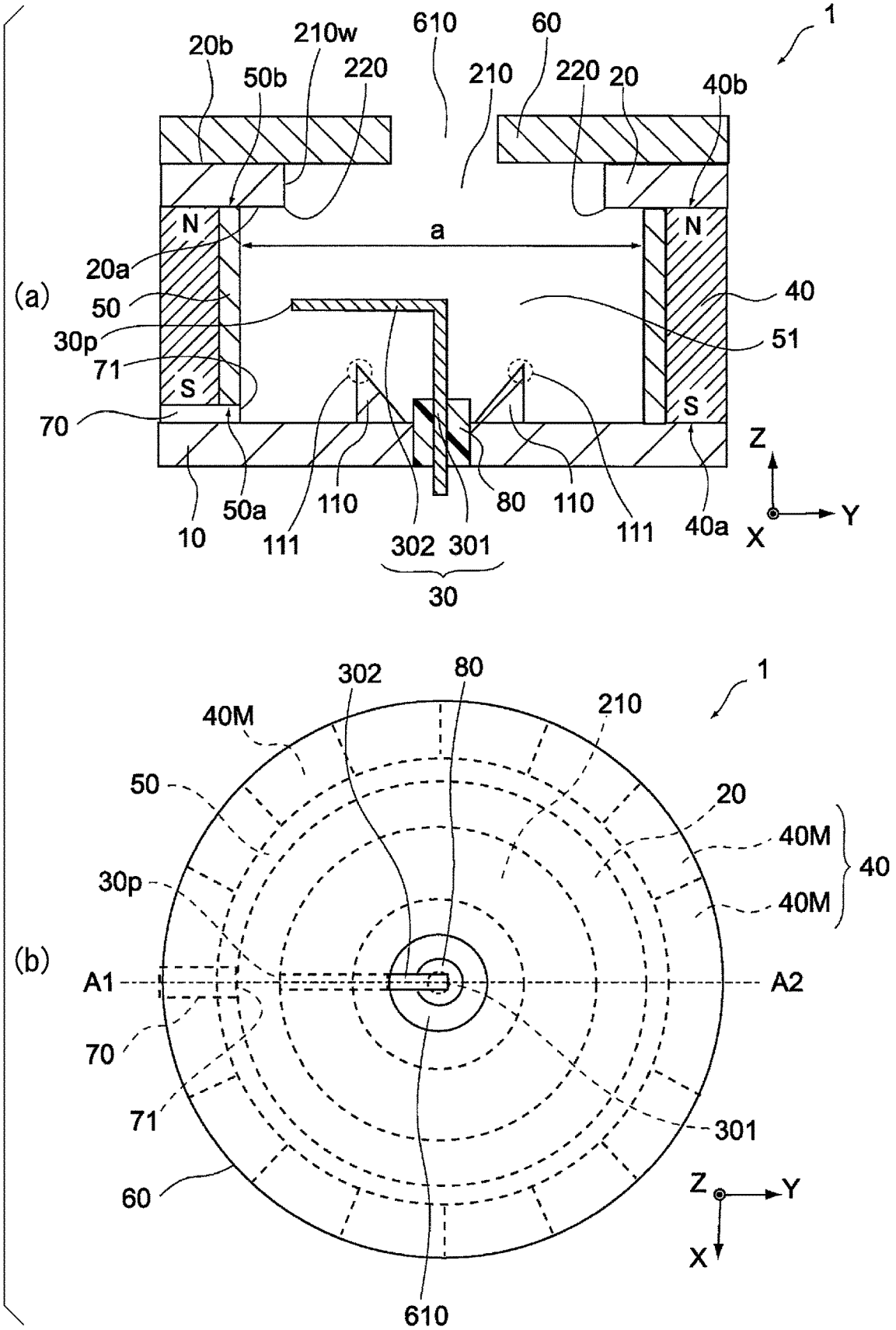
FIG. 1(*a*) is a schematic cross-sectional view of a small-sized microwave plasma source according to the present embodiment.

FIG. 1(*a*) is a schematic cross-sectional view of a small-sized microwave plasma source according to the present embodiment. FIG. 1(*b*) is a schematic top view thereof. FIG. 1(*a*) shows a cross section at a location of an A1-A2 line in FIG. 1(*b*).

A small-sized microwave plasma source shown in FIGS. 1(*a*) and 1(*b*) is an ECR plasma source in which electron cyclotron resonance is used. The small-sized microwave plasma source 1 includes a tubular magnet portion 40, a tubular body 50, a first magnetic circuit portion 10, a second magnetic circuit portion 20, an antenna 30, a nozzle portion 60, a gas port portion 70, and an insulating member 80.

The tubular magnet portion 40 is a tubular magnetic body and is hollow inside. The tubular magnet portion 40 has an opening end 40*a* (first opening end) and an opening end 40*b* (second opening end) located on a side opposite to the opening end 40*a*. In the tubular magnet portion 40, for example, the opening end 40*a* has an S polarity (first polarity), and the opening end 40*b* has an N polarity (second polarity) opposite to the S polarity.

In the tubular magnet portion 40, for example, a plurality of block-shaped magnets 40M made of samarium cobalt is circularly arranged in an X-Y plane. The polarities in the tubular magnet portion 40 are not limited to the above-described example, and the opening end 40*a* may exhibit the N polarity, and the opening end 40*b* may exhibit the S polarity.

The outer shape of the tubular magnet portion 40 is, for example, a circular shape. The outer diameter of the tubular magnet portion 40 is, for example, 50 mm or less, and the size reduction of the small-sized microwave plasma source 1 is realized. The outer shape of the tubular magnet portion 40 is not limited to a circular shape and may be a polygonal shape such as a triangular shape, a quadrangular shape, a pentagonal shape, or a hexagonal shape.

The tubular body 50 is surrounded by the tubular magnet portion 40. The tubular body 50 is hollow inside. The tubular body 50 has an opening end 50*a* and an opening end 50*b* located on a side opposite to the opening end 50*a*. The opening end 50*a* is configured to be flush with the opening end 40*a*. The opening end 50*b* is configured to be flush with the opening end 40*b*. In the X-Y plane, the tubular body 50 and the tubular magnet portion 40 are concentrically disposed. The tubular body 50 and the tubular magnet portion 40 do not need to be concentrically disposed, and central axes thereof may deviate from each other.

The outer shape of the tubular body 50 is appropriately changed in accordance with the outer shape of the tubular magnet portion 40. In an example of FIG. 1(*b*), the outer shape of the tubular body 50 is a circular shape. The tubular body 50 includes, for example, molybdenum (Mo).

The magnetic circuit portion 10 (first magnetic circuit portion) is in contact with the opening end 40*a* of the tubular magnet portion 40 and the opening end 50*a* of the tubular body 50. The magnetic circuit portion 10 closes the opening ends 40*a* and 50*a*. Here, "closing" means not only a case where the magnetic circuit portion 10 tightly seals the opening ends 40*a* and 50*a* with no gaps therebetween, but also a case where there is a fine gap therebetween or a case where the magnetic circuit portion closes the opening ends in a state in which a small-diameter hole for letting other members to penetrate is provided in the magnetic circuit portion 10. The magnetic circuit portion 10 has a plate shape. The magnetic circuit portion 10 is a ferromagnetic body and is made of, for example, soft iron. The outer shape of the magnetic circuit portion 10 is appropriately changed in accordance with the outer shape of the tubular magnet portion 40. In an example of FIG. 1(*b*), the outer shape of the magnetic circuit portion 10 is a circular shape.

The magnetic circuit portion 10 has a protrusion portion 110 provided in a space 51. The protrusion portion 110 protrudes toward the nozzle portion 60 from the magnetic circuit portion 10. The protrusion portion 110 has a tubular shape and surrounds a part of the antenna 30. A tip portion 111 of the protrusion portion 110 has a thickness becoming thinner toward a corner portion 220 of the magnetic circuit portion 20 (second magnetic circuit portion). The angle of the tip portion 111 is, for example, is configured to be an acute angle. The mirror ratio of a magnetic field formed between the tip portion 111 and the corner portion 220 is three or higher. In addition, in order to mirror-confine ECR-heated electrons, the magnetic field intensity of the tip portion 111 and the corner portion 220 needs to be higher than that of an ECR magnetic field. A microwave frequency f and an ECR magnetic field B has a relationship $2\pi f = eB/m$. Here, e represents an elementary charge, and m represents an electron mass. In a case where the microwave frequency is 2.45 GHz, the ECR magnetic field reaches 875 Gauss.

The magnetic circuit portion 20 is in contact with the opening end 40*b* of the tubular magnet portion 40 and the opening end 50*b* of the tubular body 50. The magnetic circuit portion 20 is disposed opposite to the magnetic circuit portion 10 through the tubular magnet portion 40. The magnetic circuit portion 20 has a plate shape. The magnetic circuit portion 20 is a ferromagnetic body and is made of, for example, soft iron. The outer shape of the magnetic circuit portion 20 is appropriately changed in accordance with the outer shape of the tubular magnet portion 40. In an example of FIG. 1(*b*), the outer shape of the magnetic circuit portion 20 is a circular shape.

The magnetic circuit portion 20 has an opening part 210 (first opening part) that opens the space 51 surrounded by the tubular body 50. The opening part 210 is concentrically disposed with the magnetic circuit portions 10 and 20. The opening part 210 does not need to be concentrically disposed with the magnetic circuit portions 10 and 20, and central axes thereof may deviate from each other. The inner diameter of the opening part 210 is larger than the outer diameter of the protrusion portion 110.

The opening part 210 is provided in the magnetic circuit portion 20, whereby the corner portion 220 at which a main surface 20*a* of the magnetic circuit portion 20 on a magnetic circuit portion 10 side and an inner wall 210*w* of the opening part 210 intersect with each other is formed in the magnetic circuit portion 20. In an example of FIG. 1(*a*), the angle of the corner portion 220 is approximately 90°. The angle of the corner portion 220 may also be an acute angle. For example, in a case where the angle of the corner portion 220 is an acute angle, the cross-sectional shape of the opening part 210 becomes a taper shape in which the inner diameter of the opening part gradually increases as the opening part gets away from the magnetic circuit portion 10. A main surface located on a side opposite to the main surface 20*a* of the magnetic circuit portion 20 is referred to as a main surface 20*b*.

The antenna 30 is introduced from the outside of the small-sized microwave plasma source 1 to the inside of the small-sized microwave plasma source 1. For example, the antenna 30 penetrates the magnetic circuit portion 10 and is introduced to the space 51. The antenna 30 is a so-called microwave launcher. The antenna 30 includes, for example, molybdenum.

For example, a microwave transmitter (not shown) is provided outside the small-sized microwave plasma source 1, and the microwave transmitter is connected to the antenna 30. Therefore, microwave power is supplied to the space 51 through the antenna 30. The wavelength of the microwaves is, for example, 122 mm (2.45 GHz). However, the wavelength of the microwaves is not limited to this wavelength.

The antenna 30 has a rod shape and is bent in the middle. For example, the antenna 30 has a first antenna portion 301 and a second antenna portion 302 connected to the first antenna portion 301.

The first antenna portion 301 is, for example, orthogonal to the magnetic circuit portion 10 and extends toward the nozzle portion 60 from the magnetic circuit portion 10. The first antenna portion 301 is located, for example, at the central axis of the magnetic circuit portion 10.

The second antenna portion 302 intersects with the first antenna portion 301. In the example of FIG. 1(*a*), the first antenna portion 301 and the second antenna portion 302 are orthogonal to each other, and the antenna 30 forms an L shape. The second antenna portion 302 is, furthermore, located between the tip portion 111 and the corner portion 220. That is, the second antenna portion 302 is inserted into a magnetic field B1. As described above, the antenna 30 is configured to bend, whereby microwaves are efficiently absorbed into the plasma. The angle formed by the first antenna portion 301 and the second antenna portion 302 is not limited to a right angle and may also be an obtuse angle or an acute angle.

The nozzle portion 60 is in contact with the magnetic circuit portion 20 on a side opposite to the magnetic circuit portion 10. For example, the nozzle portion 60 is in contact with the main surface 20*b* of the magnetic circuit portion 20. The nozzle portion 60 has an opening part 610 (second opening part). The opening part 610 communicates with the opening part 210. The opening area of the opening part 610 is smaller than the opening area of the opening part 210.

The opening part 610 is concentrically disposed with the opening part 210. The opening part 610 does not need to be concentrically disposed with the opening part 210, and central axes thereof may deviate from each other. The inner diameter of the opening part 610 is, for example, 5 mm. The space 51 communicates with the outside of the device through the opening part 610, whereby it is possible to extract plasma formed in the space 51 from the opening part 610. The nozzle portion 60 includes, for example, molybdenum.

The gas port portion 70 penetrates the tubular magnet portion 40 and the tubular body 50. The gas port portion 70 is disposed, for example, between the magnetic circuit portion 10 and the tubular magnet portion 40 and the tubular body 50. The gas port portion 70 is capable of supplying a discharge gas such as xenon, argon, helium, or nitrogen to the space 51.

In the gas port portion 70, a supply opening 71 through which the discharge gas is supplied is disposed such that the distance between the supply opening 71 and a tip 30*p* of the antenna 30 becomes shortest. For example, in the case of seeing the gas port portion 70 and the antenna 30 from above in a Z-axis direction, the supply opening 71 and the tip 30*p* are facing each other.

The insulating member 80 is provided between the antenna 30 and the magnetic circuit portion 10. The insulating member 80 includes a fluorocarbon resin, silica, or the like. Therefore, the antenna 30 and the magnetic circuit portion 10 are maintained to be insulated from each other.

In the small-sized microwave plasma source 1, when the inner diameter (width) of the tubular body 50 is represented by a (mm), and the microwave cutoff wavelength of the microwave power being supplied to the space 51 is represented by λ (mm), the small-sized microwave plasma source 1 is configured to satisfy a relational expression $\lambda > 3.41 \times (a/2)$. In a case where the tubular body 50 is a polygon, the inner diameter a is the maximum inner diameter that pass through the central axis of the tubular body 50.

Figure 2:
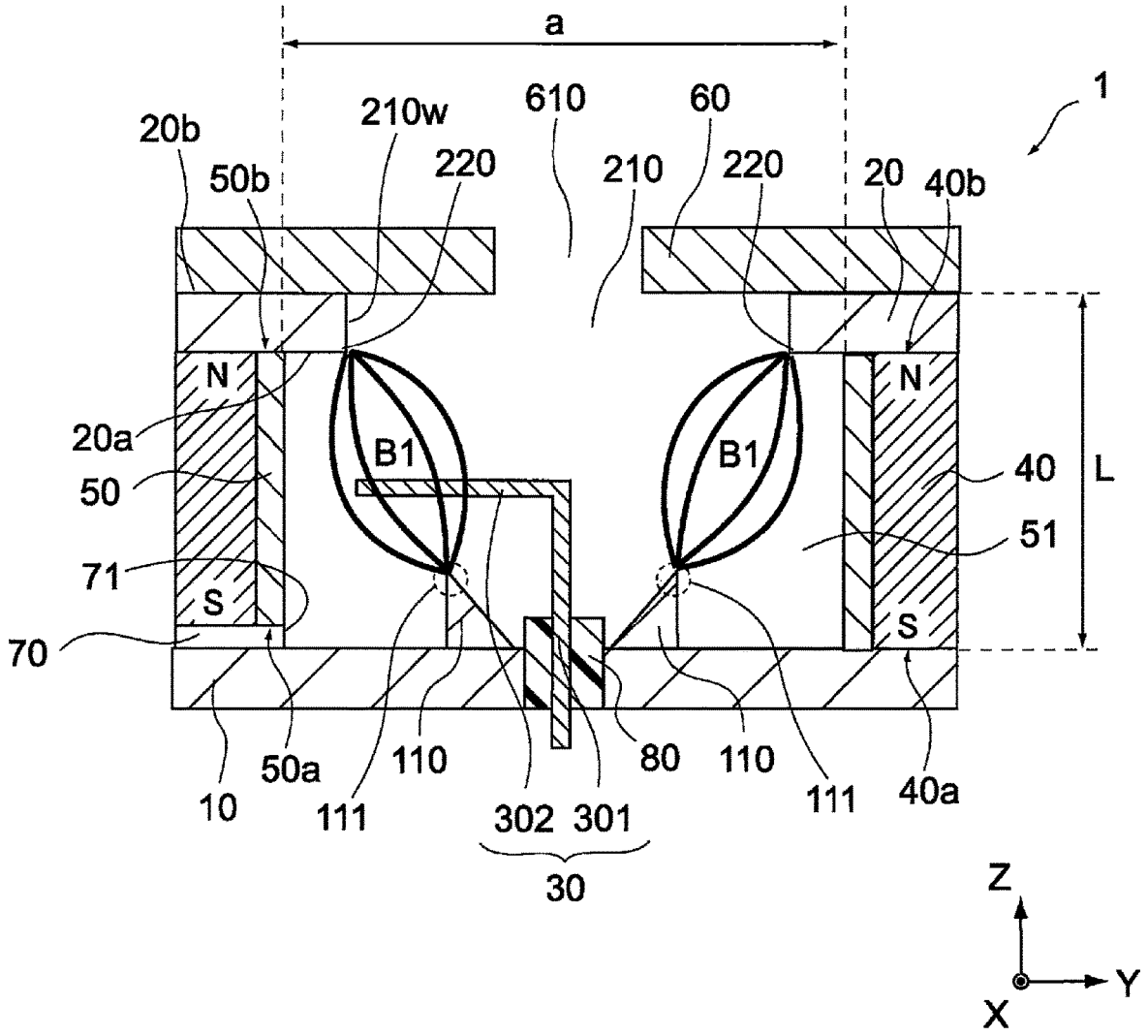
FIG. 2 is a schematic cross-sectional view showing an operation of the small-sized microwave plasma source.

FIG. 2 is a schematic cross-sectional view showing an operation of the small-sized microwave plasma source.

In the small-sized microwave plasma source 1, the magnetic circuit portion 10 connected to the tubular magnet portion 40 and the magnetic circuit portion 20 connected to the tubular magnet portion 40 respectively function as a yoke material. Furthermore, the magnetic circuit portion 10 has the protrusion portion 110, and the magnetic circuit portion 20 has the corner portion 220. Therefore, the magnetic field B1 having a high mirror ratio (mirror magnetic field) is formed between both protrusions (between the protrusion portion 110 and the corner portion 220). Furthermore, the protrusion portion 110 is tubular, and the opening part 210 of the magnetic circuit portion 20 is circular, and thus the magnetic field B1 is formed in an annular shape.

Under such a circumstance, when the discharge gas is supplied to the space 51 from the supply opening 71, and microwaves are supplied to the space 51 from the antenna 30, the discharge gas is discharged, and electron cyclotron resonance occurs in the space 51 due to the interaction between the microwaves and the magnetic field B1. Therefore, energy is selectively and directly supplied to electrons in plasma, and electrons having a high energy and the discharge gas collide with each other, thereby generating high-density plasma in the space 51.

Here, the small-sized microwave plasma source 1 is configured to satisfy a relational expression $\lambda > 3.41 \times (a/2)$. Therefore, in the space 51, microwaves do not easily resonate, and the progress of the microwaves in the space 51 is suppressed. As a result, microwaves do not easily leak from the small-sized microwave plasma source 1. In addition, the prevention of resonance prevents an increase in a microwave electric field, and it is possible to suppress a microwave loss on a container wall surface which is proportional to the microwave electric field.

Furthermore, in the small-sized microwave plasma source 1, the mirror magnetic field (magnetic field B1) is formed between the protrusion portion 110 and the corner portion 220, and electrons confined in the magnetic field B1 are continuously heated by electron cyclotron resonance. Therefore, it is possible to generate high-energy electrons capable of ionizing the discharge gas even when an electric field of microwaves is weak.

In addition, in the small-sized microwave plasma source 1, the inner diameter of the opening part 210 is configured to be larger than the outer diameter of the protrusion portion 110. Therefore, in the magnetic field B1, lines of magnetic force become less dense from the protrusion portion 110 toward the corner portion 220. As a result, the magnetic flux density on a nozzle portion 60 side becomes smaller than the magnetic flux density on a protrusion portion 110 side.

Therefore, in the space 51, a low-magnetic field region is formed in the vicinity of the opening part 610 of the nozzle portion 60, and in the vicinity of the opening part 610, plasma is not easily trapped by the magnetic field. Therefore, the mobility of the plasma in the vicinity of the opening part 610 increases, and electrons or ions in the plasma are efficiently sprayed from the opening part 610.

For example, when xenon gas is introduced to the space 51 from the supply opening 71 at a flow rate of approximately 0.3 sccm, and eight-watt microwaves are injected into the antenna 30, an electron current of approximately 200 mA and an ion current of approximately 5 mA are obtained from the opening part 610.

The ions in the plasma remaining in the space 51 pass through the magnetic field B1 and reach an inner wall of the tubular body 50 or the main surfaces of the magnetic circuit portions 10 and 20. The ions that have stricken the tubular body 50 or the magnetic circuit portions 10 and 20 lose a charge, return to a neutral gas and are reused as the discharge gas. Therefore, in the small-sized microwave plasma source 1, it becomes possible to maintain plasma at an extremely small gas flow rate.

On the other hand, on the protrusion portion 110 side, the lines of magnetic force become more dense from the corner portion 220 toward the protrusion portion 110. Therefore, in the vicinity of the insulating member 80, a high-magnetic field region is formed, and, in the plasma formed in the space 51, the density of the plasma exposed to the insulating member 80 becomes higher than the density of the plasma formed in the opening part 210.

Therefore, even when a foreign substance such as a contaminant or a coating is deposited on the insulating member 80 during discharge, the foreign substance is immediately removed by a sputtering effect of the plasma. In the case that the foreign substance includes metal and the foreign substance is deposited on the insulating member 80, the antenna 30 and the magnetic circuit portion 10 are electrically connected to each other, and it becomes impossible to sufficiently supply microwaves to the space 51 from the antenna 30.

In contrast, in the small-sized microwave plasma source 1, as long as plasma is formed in the space 51, the foreign substance on the insulating member 80 is removed by self-cleaning. That is, the small-sized microwave plasma source 1 can be operated for a long period of time without maintenance.

In addition, in the small-sized microwave plasma source 1, the supply opening 71 and the tip 30*p* of the antenna 30 are configured to be closest to each other, and thus the discharge gas is supplied to the vicinity of the second antenna portion 302. Therefore, the discharge gas introduced to the space 51 from the supply opening 71 is efficiently ionized by microwaves emitted from the antenna 30. As a result, high-density plasma is formed in the space 51.

In addition, when the distance between the magnetic circuit portion 10 and the nozzle portion 60 is represented by L (mm), the small-sized microwave plasma source 1 may be configured to satisfy the relational expression $\lambda > 3.41 \times (a/2)$. Therefore, it becomes more difficult for microwaves to leak from the opening part 610 of the nozzle portion 60.

According to the above-described small-sized microwave plasma source 1, microwaves do not easily leak from the small-sized microwave plasma source 1, high-density plasma is generated by the small-sized microwave plasma source 1, and it is possible to spray electrons or ions to the outside of the small-sized microwave plasma source 1. The above-described small-sized microwave plasma source 1 is used in, for example, a vacuum environment ($1\times10^{-5}$ Pa or higher and $1\times10^{-2}$ Pa or lower) and can be used for neutralization that alleviates the charging of manufacturing devices and equipment requiring a vacuum environment.

Modified Example 1

Figure 3:
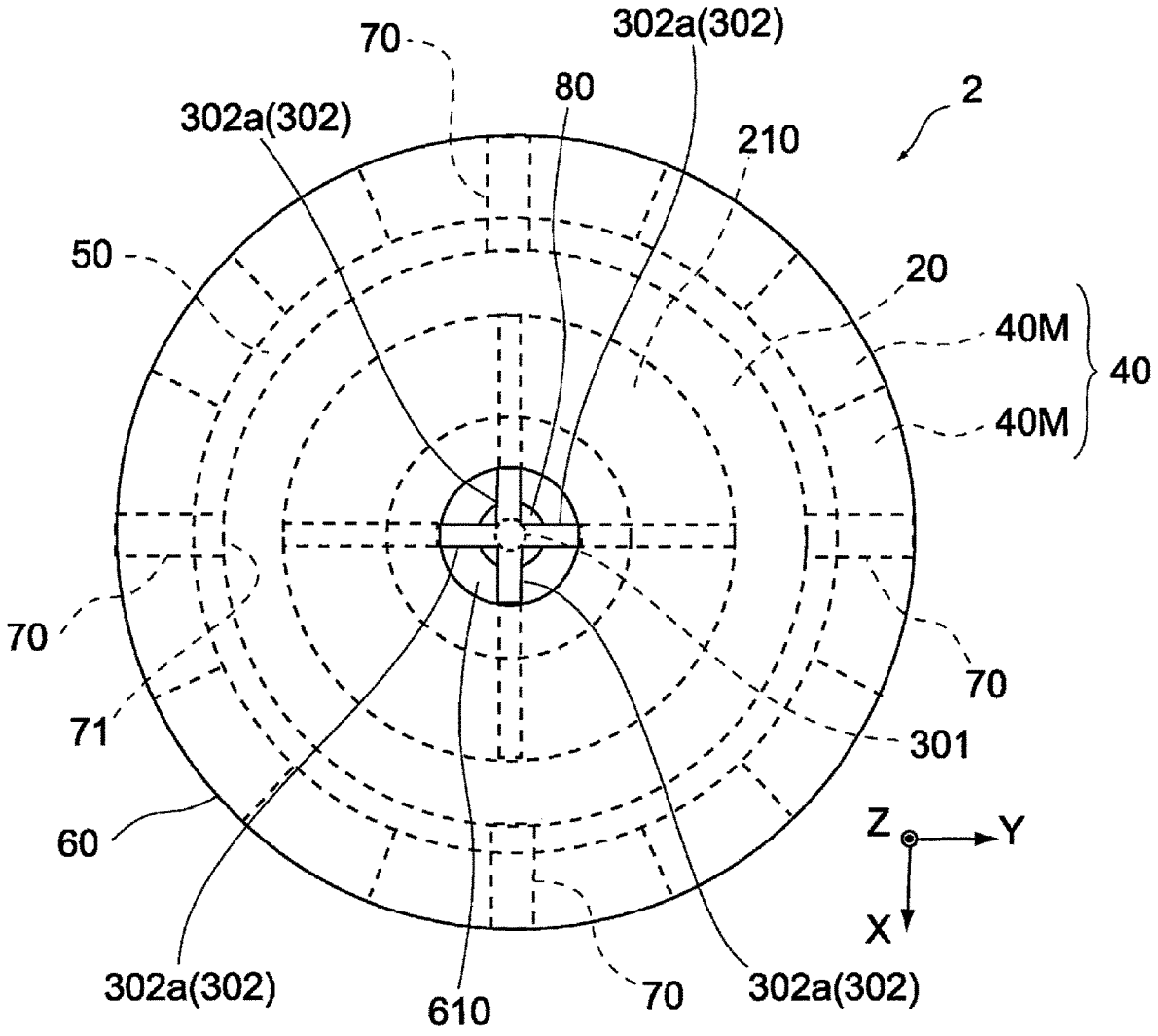
FIG. 3 is a schematic top view of a first modified example of the small-sized microwave plasma source according to the present embodiment.

FIG. 3 is a schematic top view of a first modified example of the small-sized microwave plasma source according to the present embodiment.

In a small-sized microwave plasma source 2 shown in FIG. 3, the second antenna portion 302 includes a plurality of members 302*a*. The plurality of members 302*a* each intersect with the first antenna portion 301. Furthermore, in the case of seeing the small-sized microwave plasma source 2 from above in the Z-axis direction, the plurality of members 302*a* each and the gas port portion 70 are opposite to each other.

According to the above-described configuration, electron cyclotron resonance occurs in the space 51 due to the interaction between microwaves supplied from the plurality of members 302*a* and the magnetic field B1, and higher-density plasma is generated in the space 51. Therefore, it is possible to extract a larger electron current or ion current from the small-sized microwave plasma source 2.

Modified Example 2

Figure 4:
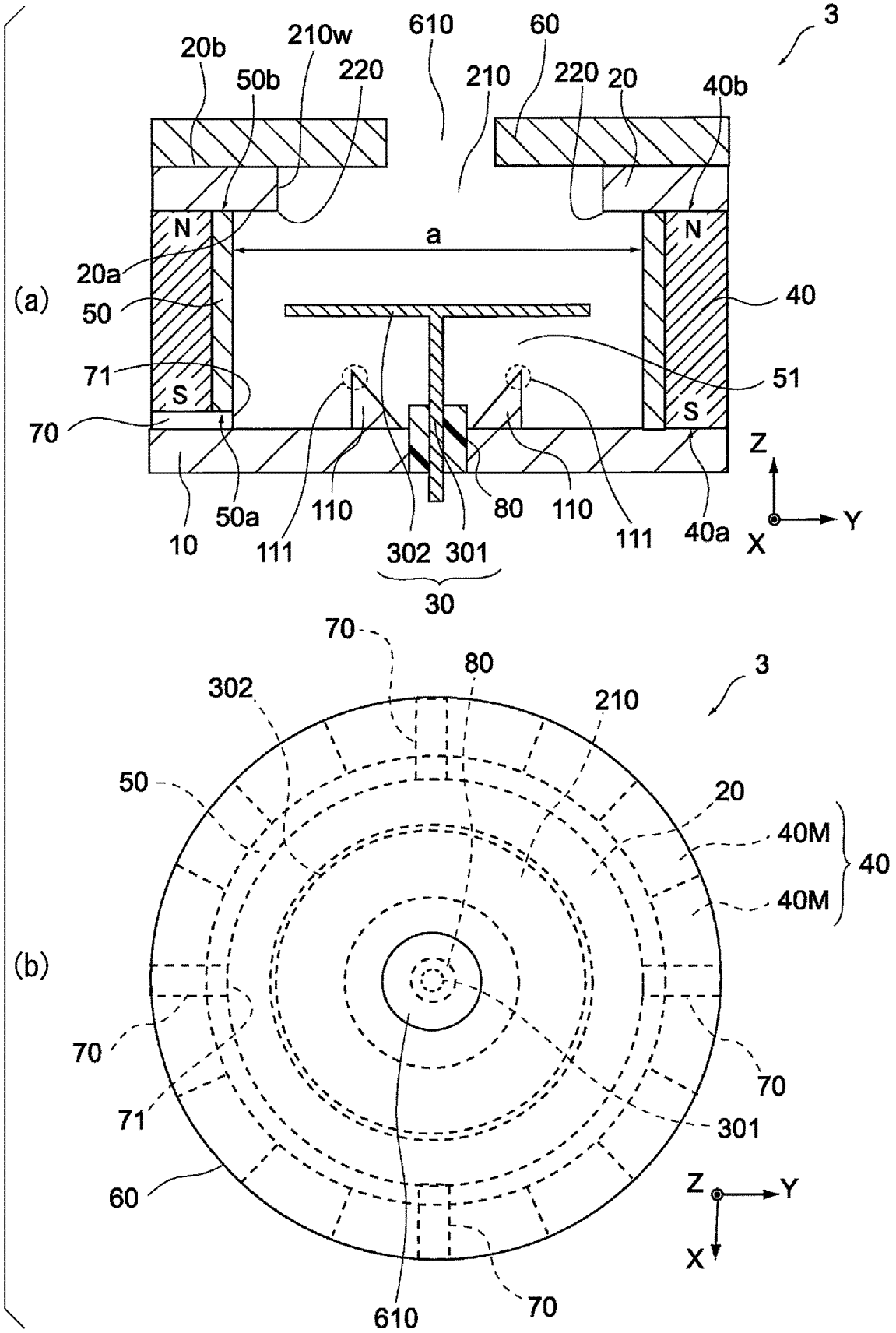
FIG. 4(*a*) is a schematic cross-sectional view of a second modified example of the small-sized microwave plasma source according to the present embodiment.

FIG. 4(*a*) is a schematic cross-sectional view of a second modified example of the small-sized microwave plasma source according to the present embodiment. FIG. 4(*b*) is a schematic top view thereof.

In a small-sized microwave plasma source 3 shown in FIGS. 4(*a*) and 4(*b*), the second antenna portion 302 is configured in a disc shape. The second antenna portion 302 may be configured in a cone shape. The first antenna portion 301 is connected to the central part of the second antenna portion 302. In addition, in the case of seeing the small-sized microwave plasma source 3 from above in the Z-axis direction, the gas port portions 70 are provided in a plurality of places.

According to the above-described configuration, electron cyclotron resonance occurs in the space 51 due to the interaction between microwaves evenly supplied from the disc-shaped or cone-shaped second antenna portion 302 and the magnetic field B1, and higher-density plasma is generated in the space 51. Therefore, it is possible to extract a larger electron current or ion current from the small-sized microwave plasma source 3.

Modified Example 3

Figure 5:
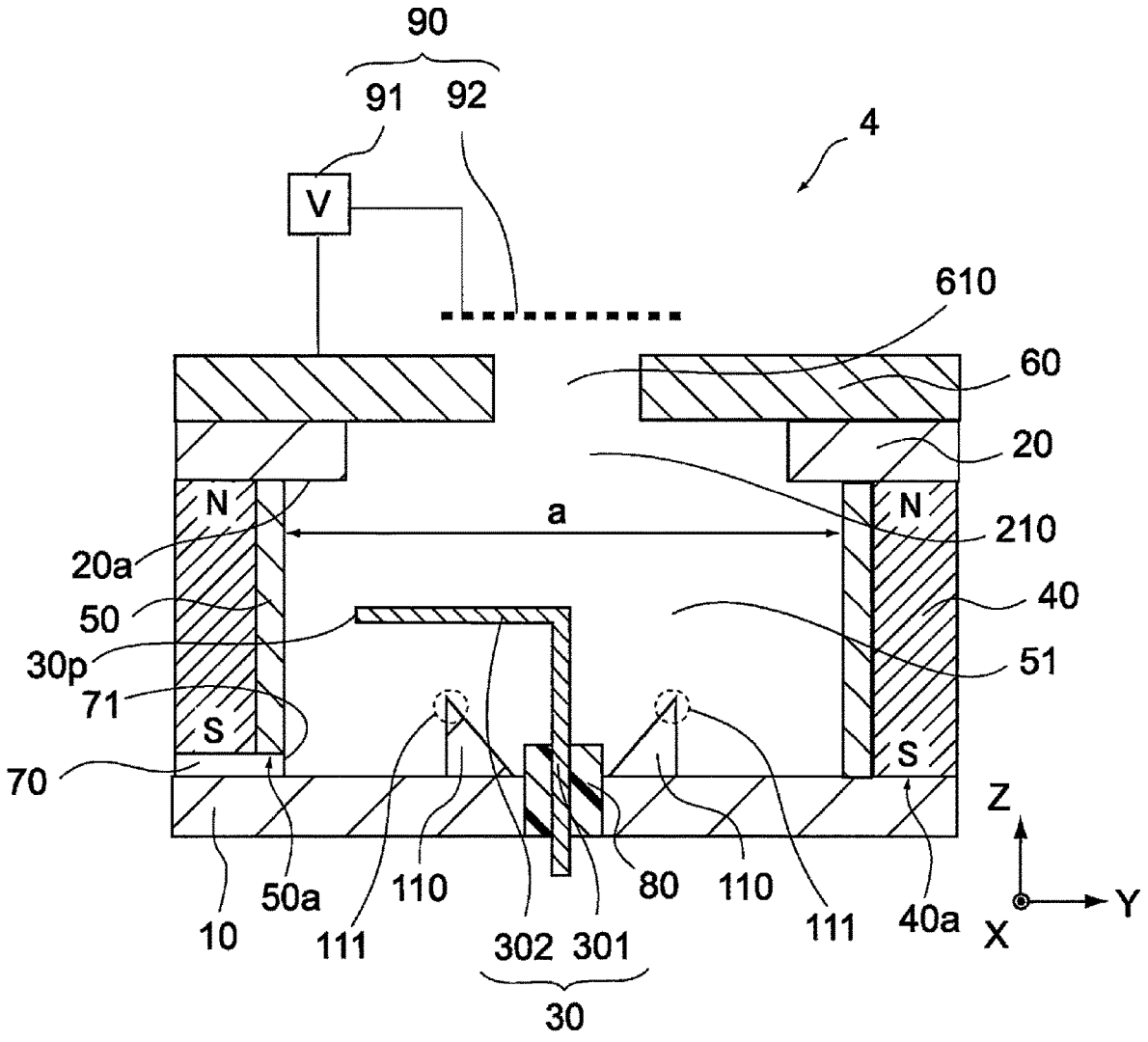
FIG. 5 is a schematic cross-sectional view of a third modified example of the small-sized microwave plasma source according to the present embodiment.

FIG. 5 is a schematic cross-sectional view of a third modified example of the small-sized microwave plasma source according to the present embodiment.

A small-sized microwave plasma source 4 shown in FIG. 5 further includes an electrode mechanism 90 that withdraws charged particles in the plasma formed in the space 51 using an electrostatic field. The electrode mechanism 90 has a power supply 91 and a porous electrode (grid electrode) 92. The electrode 92 is facing to the opening part 610 on a side opposite to the space 51.

For example, in the case of regarding the small-sized microwave plasma source 4 excluding the electrode mechanism 90 as the main body of the small-sized microwave plasma source 4, it is possible to preferentially withdraw electrons from the space 51 in the case of applying a higher bias potential (positive potential) than that of the main body to the electrode 92 using the power supply 91. On the other hand, in the case of applying a lower bias potential (negative potential) than that of the main body to the electrode 92 using the power supply 91, it is possible to preferentially withdraw ions from the space 51.

In addition, these charged particles are accelerated by an electrostatic field formed between the electrode 92 and the main body, and thus a beam flow of the charged particles having a uniform progressing direction is formed. Therefore, it is possible to determine a target subject of neutralization and neutralize the target subject.

Hitherto, the embodiment of the present invention has been described, but the present invention is not limited only to the above-described embodiment, and it is needless to say that the embodiment can be modified in a variety of manners. Individual embodiments do not necessarily need to remain as an independent aspect and can be combined together as long as technically possible.

INDUSTRIAL APPLICABILITY

According to the present invention, a microwave plasma source that forms high-density plasma and suppresses the leakage of microwaves is provided.

REFERENCE SIGNS LIST

1, 2, 3, 4 SMALL-SIZED MICROWAVE PLASMA SOURCE
10 MAGNETIC CIRCUIT PORTION
20 MAGNETIC CIRCUIT PORTION
20*a*, 20*b* MAIN SURFACE
30 ANTENNA
30*p* TIP
40 TUBULAR MAGNET PORTION
40*a*, 40*b*, 50*a*, 50*b* OPENING END
40M MAGNET
50 TUBULAR BODY
51 SPACE
60 NOZZLE PORTION
70 GAS PORT PORTION
71 SUPPLY OPENING
80 INSULATING MEMBER
90 ELECTRODE MECHANISM
91 POWER SUPPLY
92 ELECTRODE
110 PROTRUSION PORTION
111 TIP PORTION
210, 610 OPENING PART
210*w* INNER WALL
220 CORNER PORTION
301 FIRST ANTENNA PORTION
302 SECOND ANTENNA PORTION

The invention claimed is:

1. A microwave plasma source comprising:

a tubular magnet portion having a first opening end and a second opening end located on a side opposite to the first opening end, the first opening end having a first polarity and the second opening end having a second polarity opposite to the first polarity;

a tubular body surrounded by the tubular magnet portion;

a first magnetic circuit portion being in contact with the first opening end and closing the first opening end;

a second magnetic circuit portion being in contact with the second opening end, being disposed opposite to the first magnetic circuit portion, and having a first opening part that opens a space surrounded by the tubular body;

an antenna penetrating the first magnetic circuit portion, being introduced to the space, and being capable of supplying microwave power to the space;

a nozzle portion being in contact with the second magnetic circuit portion on a side opposite to the first magnetic circuit portion and having a second opening part that has a smaller opening area than the first opening part and communicates with the first opening part;

a gas port portion penetrating the tubular magnet portion and the tubular body and being capable of supplying a discharge gas to the space; and an insulating member provided between the antenna and the first magnetic circuit portion, wherein, when an inner diameter of the tubular body is represented by a (mm), and a microwave cutoff wavelength of the microwave power being supplied to the space is represented by $\lambda$ (mm), the microwave plasma source is configured to satisfy a relational expression $\lambda > 3.41 \times (a/2)$, and wherein, in the case of seeing the tubular magnet portion from above in a direction along a central axis of the tubular magnet portion, a supply opening of the discharge gas of the gas port portion and a tip of the antenna are facing each other, the first magnetic circuit portion has a tubular protrusion portion that protrudes toward the nozzle portion from the first magnetic circuit portion in the space, the protrusion portion surrounds a part of the antenna, the protrusion portion includes a tip portion tapering toward a corner portion at which a main surface of the second magnetic circuit portion on a first magnetic circuit portion side and an inner wall of the first opening part intersect with each other, and a mirror ratio of a magnetic field formed between the tip portion and the corner portion is three or higher.

2. The microwave plasma source according to claim 1, wherein at least any one of the tip portion and the corner portion is configured to have an acute angle.

3. The microwave plasma source according to claim 1,

Wherein an inner diameter of the first opening part is larger than an outer diameter of the protrusion portion.

4. The microwave plasma source according to claim 1, wherein, in plasma generated by the discharge gas formed in the space, a density of the plasma exposed to the insulating member is higher than a density of the plasma formed in the first opening part.

5. The microwave plasma source according to claim 1, wherein the antenna has a first antenna portion extending from the first magnetic circuit portion toward the nozzle portion and a second antenna portion that intersects with the first antenna portion and is connected to the first antenna portion.

6. The microwave plasma source according to claim 5, wherein the second antenna portion includes a plurality of members, and the plurality of members each intersect with the first antenna portion.

7. The microwave plasma source according to claim 1, wherein the antenna has a first antenna portion extending in a direction toward the nozzle portion from the first magnetic circuit portion and a second antenna portion formed in a disc shape or a cone shape, and the first antenna portion is connected to a central part of the second antenna portion.

8. The microwave plasma source according to claim 1, wherein, in the gas port portion, a supply opening of the discharge gas is disposed such that a distance between the supply opening and a tip of the antenna becomes shortest.

9. The microwave plasma source according to claim 1, further comprising:

an electrode mechanism that withdraws charged particles in plasma formed in the space using an electrostatic field.

* * * * *